US006893236B2

(12) United States Patent
Jeong

(10) Patent No.: US 6,893,236 B2
(45) Date of Patent: May 17, 2005

(54) APPARATUS FOR PREVENTING REVERSE ROTATION OF SCROLL COMPRESSOR

(75) Inventor: Chan-Hwa Jeong, Changwon (KR)

(73) Assignee: LG Electronics Inc., Seoul (KR)

( * ) Notice: Subject to any disclaimer, the term of this patent is extended or adjusted under 35 U.S.C. 154(b) by 5 days.

(21) Appl. No.: 10/748,296

(22) Filed: Dec. 31, 2003

(65) Prior Publication Data

US 2004/0208766 A1 Oct. 21, 2004

(30) Foreign Application Priority Data

Apr. 17, 2003 (KR) ..... 10-2003-0024479

(51) Int. Cl.[7] ..... F04C 18/00

(52) U.S. Cl. ..... 418/55.5; 418/55.6; 418/57; 418/55.1

(58) Field of Search ..... 418/55.5, 55.6, 418/57, 55.1

(56) References Cited

U.S. PATENT DOCUMENTS 5,474,434 A * 12/1995 Wada et al. ..... 418/55.5
6,106,251 A * 8/2000 Monnier et al. ..... 418/55.5
6,428,294 B1 * 8/2002 Fenocchi ..... 418/55.5
6,471,499 B1 * 10/2002 Sun ..... 418/55.5

FOREIGN PATENT DOCUMENTS

JP 05248371 A * 9/1993 ..... F04C/18/02
KR 2001057496 A * 7/2001 ..... F04C/18/02

* cited by examiner

*Primary Examiner*—Theresa Trieu
(74) *Attorney, Agent, or Firm*—Birch, Stewart, Kolasch & Birch, LLP

(57) ABSTRACT

An apparatus for preventing a rotation of a scroll compressor in a reverse direction of compressing fluid is described herein. The apparatus comprises an eccentric portion of a rotational shaft that is coupled with an orbiting scroll meshed with a fixed scroll and a slide bush interposed between the eccentric portion and the orbiting scroll. The eccentric portion has a sloping plane at an outer periphery surface thereof and the sloping plane thereof contacts with a sloping plane formed at an inner periphery of the slide bush when the scroll compressor is driven in a direction opposite to a driving direction of compressing fluid. At this time, an operating angle between the contacted sloping surfaces and a reference line become large enough for a friction between the two scrolls to increase, thereby, a reverse rotation of the compressor can be prevented.

10 Claims, 4 Drawing Sheets

APPARATUS FOR PREVENTING REVERSE ROTATION OF SCROLL COMPRESSOR

This nonprovisional application claims priority under 35 U.S.C. § 119(a) on Patent Application No(s). 10-2003-0024479 filed in KOREA on Apr. 17, 2003, which is (are) herein incorporated by reference.

BACKGROUND OF THE INVENTION

1. Field of the Invention

The present invention relates to a scroll compressor, and more particularly, to an apparatus for preventing reverse rotation of a scroll compressor capable of preventing a compressor from being driven in a direction opposite to a driving direction of compressing a fluid.

2. Description of the Background Art

In general, several types of compressor according to a compression method can be applied to various devices, and, for a small sized and lightweight air conditioning device, a scroll compressor is mainly used.

FIG. 1 is a sectional view of a scroll compressor according to the conventional art.

A scroll compressor according to the conventional art includes a casing 1 to which a suction port 11 through which a fluid is sucked and a discharging port 12 through which a compressed fluid is discharged are connected respectively, forming a certain close space; a driving unit (D) mounted at a lower portion of the casing 1, and generating a driving force; a compression unit (P) positioned at an upper portion of the casing 1 to compress a fluid sucked through the suction port 11 and discharge the compressed fluid through the discharging port 12, using a rotational force of a rotational shaft 23, which is generated by the driving force of the driving unit (D).

A main frame 2 for supporting the compression unit (P), and supporting one end of the rotational shaft 23 to make rotation of the rotary shaft 23 possible, is installed at an upper portion of the casing 1. A lower frame 3 for rotatably supporting the other end of the rotational shaft 23 is installed at a lower portion of the casing 1.

The driving unit (D) includes a stator 4 mounted in the casing 1, and a rotor 5 rotatably inserted at the inside of the stator 4, and, at the inside of the rotor 5, the rotational shaft 23 is pressed and inserted. The rotational shaft 23 includes a shaft portion 20 having a certain length, and pressed and inserted at the rotor 5, and an eccentric portion 21 formed at one end of the shaft portion 20 to be eccentric from the center of the shaft portion 20, and connected with the compression unit (P).

The compression unit (P) includes a fixed scroll 7 fixedly coupled with the main frame 2, and an orbiting scroll 8 meshed with the fixed scroll 7, and also coupled with the rotational shaft 23. A slide bush 6 is inserted at a lower portion of the orbiting scroll 8, and the eccentric portion 21 of the rotational shaft 23 is inserted to be coupled with the slide bush 6. A suction hole 7*a* through which gas, which has passed through the suction pipe 11, is flown into a compression space formed between the orbiting scroll 8 and the fixed scroll 7, is formed at one side of the fixed scroll 7. At an upper portion of the fixed scroll 7, a discharging hole 7*b* through which compressed gas is discharged, is formed, and, at an upper side of the discharging hole 7*b*, a check valve (not shown) for preventing the discharged fluid from flowing backward, is installed. An Oldham ring 9 for preventing self-rotation of the orbiting scroll 8 is installed between the orbiting scroll 8 and the main frame 2. At an upper surface of the fixed scroll 7, a dividing plate 10 for dividing the inside of the casing 1 into a low pressure area (N) and a high pressure area (M), is installed.

FIG. 2 is a disassembled perspective view showing a slide bush and an eccentric portion of a rotational shaft according to the conventional art.

As shown therein, the eccentric portion 21 of the rotational shaft has a cylindrical form with a certain length. At an outer circumference thereof, a first and second outer planes 23*a* and 23*b* are formed so as to be parallel with or have a predetermined angle on the basis of a reference line connecting the center of the shaft portion 20 of the rotational shaft and the center of the eccentric portion 21, and outer circumferential surfaces 24*a* and 24*b* connecting the first and second outer planes 23*a* and 23*b* are formed.

Also, the slide bush 6 has a cylindrical form with a certain length, and an inserting hole 40 penetrates the inside of the slide bush 6 so that the eccentric portion 21 of the rotational shaft can be inserted therein at a variable gap therebetween. At an inner circumferential surface of the suction hole 40, a first and second inner planes 26*a* and 26*b* are formed so as to confront with the first and second outer plane 23*a* and 23*b* formed at the outer circumferential surface of the eccentric portion 21 of the rotational shaft respectively.

Operations of the conventional scroll compressor configured as above will now be described.

When power is applied to a stator 4, a rotor 5 rotates by an electromagnetic interaction of the stator 4 and the rotor 5, and a rotational shaft 23 fixed at the rotor 5 rotates forwardly. At this time, one of the first and second outer planes 23*a* and 23*b*, which is formed toward a forward rotation direction on the basis of the reference line connecting the axis of the shaft portion 20 of the rotational shaft 23 and the axis of the eccentric portion 21 thereof is in contact with one of the first and second inner planes 26*a* and 26*b* of the inner circumferential surface of the inserting hole 40 of the slide bush 6. Through this contact of the planes, the rotational force of the rotational shaft 23 is transmitted to the slide bush 6, and, after all, transmitted to the orbiting scroll 8 inserted at and connected with an outer circumferential surface of the slide bush 6. At this time, the orbiting scroll 8 starts to orbit.

A fluid sucked through the suction port 11 by the interaction of the orbiting scroll 8, which is orbiting, and the fixed scroll 7, is compressed and discharged to the outside.

At this time, a check valve (not shown) installed at the discharging hole 7*b* prevents the fluid, which has been discharged to a high pressure area (M) through the discharging hole 7*b*, from flowing backward to the low pressure area (N).

However, to the conventional scroll compressor above, several apparatuses for preventing reverse rotation is applied in order to prevent damage of the compressor, which is caused by the reverse rotation generated by the following reasons, but there are still remained problems below.

In case of applying a single-phase motor as a driving unit for generating a rotational force, if a load generated during an operation of the compressor becomes greater than a motor torque, a rotational force of a motor is reduced, further, the motor is rotated reversely, and thus, the orbiting scroll is rotated reversely. Accordingly, an abnormal oscillation and noise of the compressor are generated, and reliability of the compressor is deteriorated.

Also, in case of applying a three-phase motor as a driving unit for generating a rotational force, if wiring of a motor is not right, and so supply power is changed, the motor is rotated reversely, and thus the compressor is damaged. In order to solve this problem, a reversed-phase preventing circuit is attached. When the phase of the supply power is changed, the reverse-phase preventing circuit turns off power supplied to the compressor so that the compressor cannot be operated, and thus protects the compressor. However, since, in installing the circuit, expenses are increased, and there still exists a possibility for the compressor to be ill-operated according to a complicated configuration, reliability of the compressor is deteriorated.

Also, there is a method applying a single direction clutch structure between the rotational shaft 23 and a lower frame 3, but in this case, expenses for installing is increased too. Also, since a roller portion of a clutch has to be continuously operated therewith even in a normal operation, damage of power is generated whereby efficiency is deteriorated, and noise is generated too by an unnecessary movement.

SUMMARY OF THE INVENTION

Therefore, an object of the present invention is to provide an apparatus for preventing reverse rotation of a scroll compressor capable of preventing damage of a compressor and an abnormal oscillation and noise, and reducing expenses in installing, by restraining a orbiting scroll from being driven in a reverse direction, which is caused since a driving unit of a compressor is driven in a direction opposite to a direction of compressing a fluid, or a load generated during an operation of the compressor is greater than motor torque.

To achieve these and other advantages and in accordance with the purpose of the present invention, as embodied and broadly described herein, there is provided an apparatus for preventing reverse rotation of a scroll compressor including a casing, a fixed-scroll installed inside the casing, a orbiting scroll meshed with the fixed scroll and defining a compression unit therewith, a rotational shaft having a shaft portion combined with a driving unit and an eccentric portion integrally formed to be eccentric from the center of one end of the shaft portion and a slide bush disposed between the eccentric portion of the rotational shaft and the orbiting scroll, wherein said apparatus comprises the eccentric portion of the rotational shaft having two outer planes formed at an outer surface thereof, and a sloping plane extended from one of the two outer planes, the sloping plane sloping on the basis of a reference line connecting the axis of the shaft portion of the rotational shaft and that of the eccentric portion thereof, and the slide bush where an inserting hole penetrates so that the eccentric portion can be inserted therein, including two inner planes formed at an inner surface of the inserting hole thereof for confronting with the planes formed at an outer surface of the eccentric portion of the rotational shaft, and a sloping plane slopingly extended from one of the two inner planes.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, an apparatus for preventing reverse rotation of a scroll compressor according to one embodiment of the present invention will now be described in detail with reference to accompanying drawings.

In drawings, a structure, which is the same as that of the conventional art, will have the same numeral, and overlapped descriptions will not be mentioned.

Figure 1:
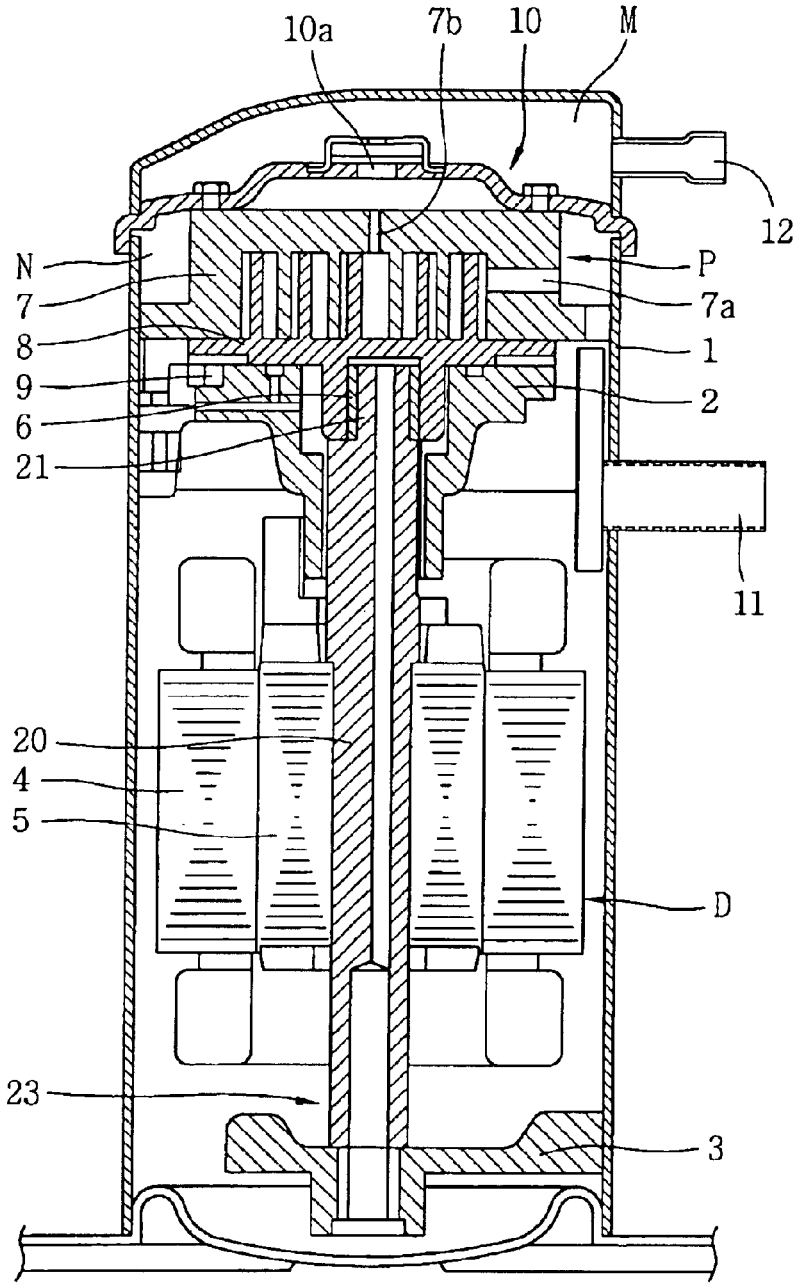
FIG. 1 CONVENTIONAL ART
FIG. 1 is a vertical sectional view of a scroll compressor according to the conventional art.
Figure 2:
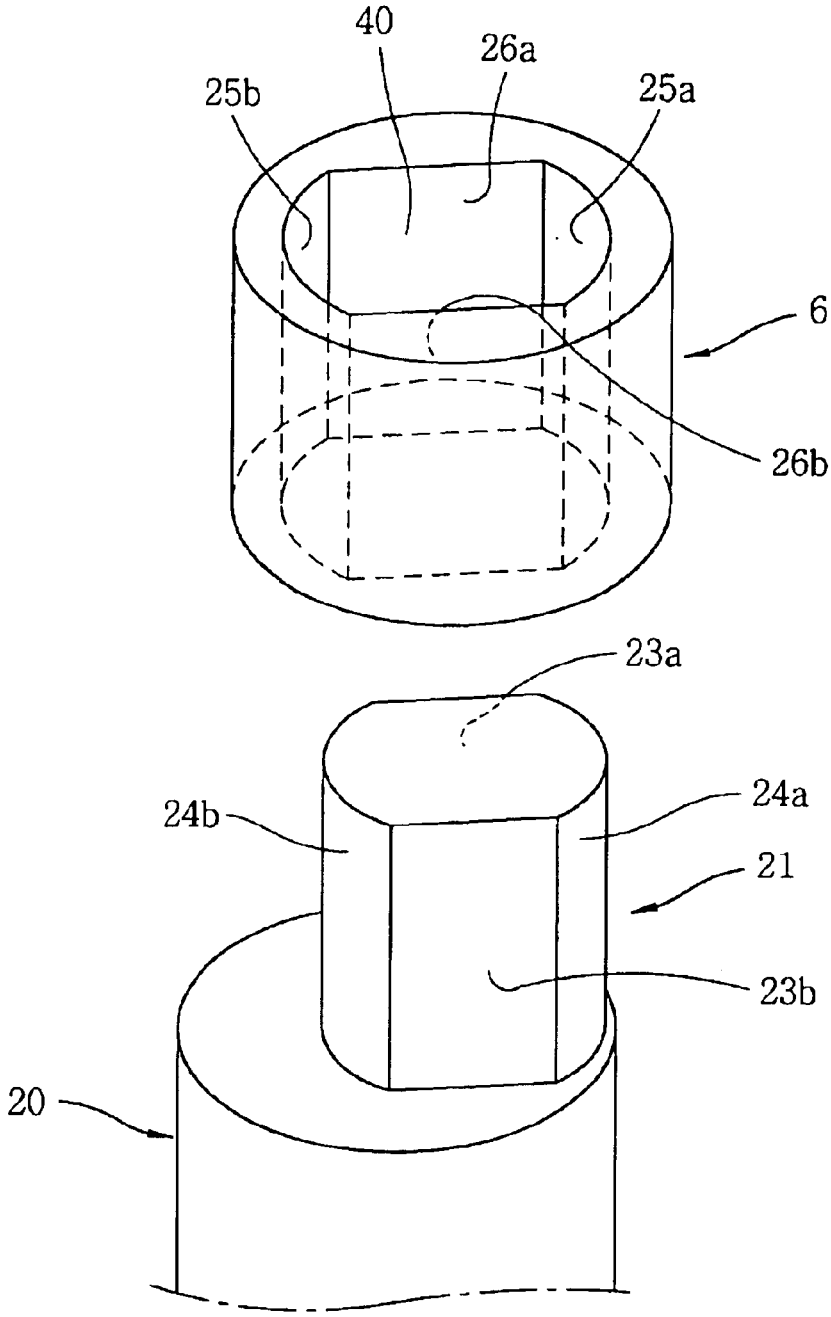
FIG. 2 CONVENTIONAL ART
FIG. 2 is a disassembled perspective view showing a conventional eccentric portion of a rotational shaft and a slide bush.
Figure 3:
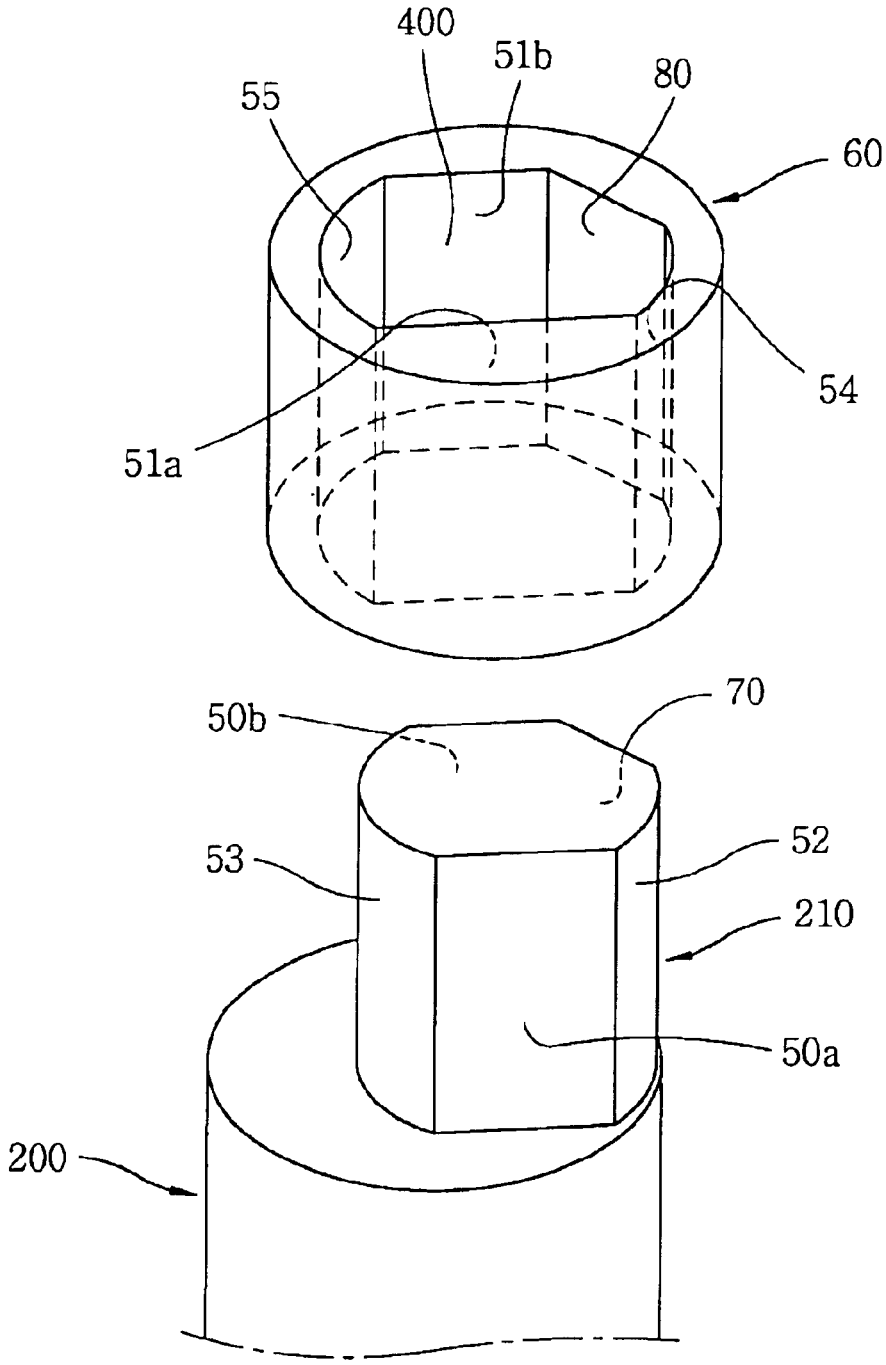
FIG. 3 is a disassembled perspective view showing an eccentric portion of a rotational shaft and a slide bush according to the present invention.
Figure 4:
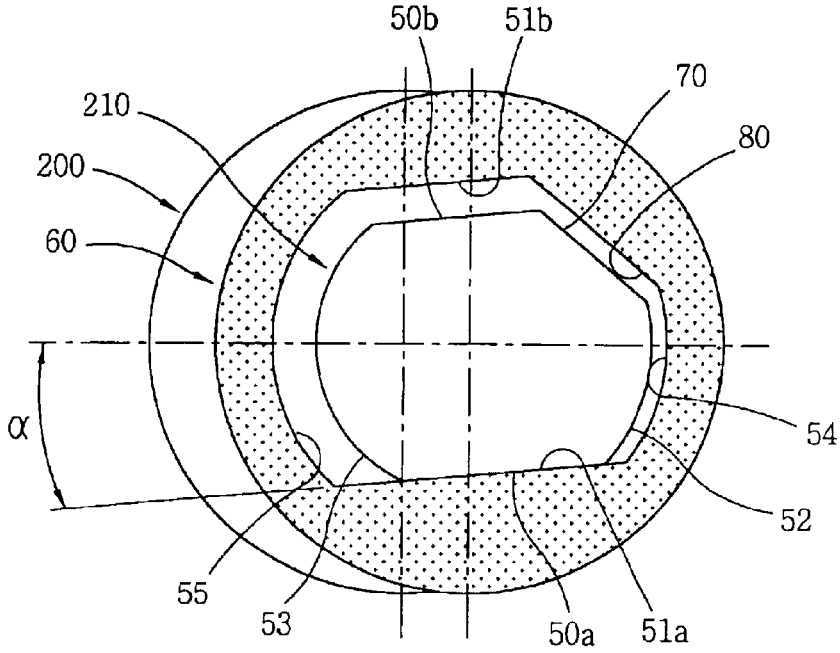
FIG. 4 is a plane view of FIG. 3 showing an eccentric portion of a rotational shaft and a slide bush in rotating in a forward direction according to the present invention.
Figure 5:
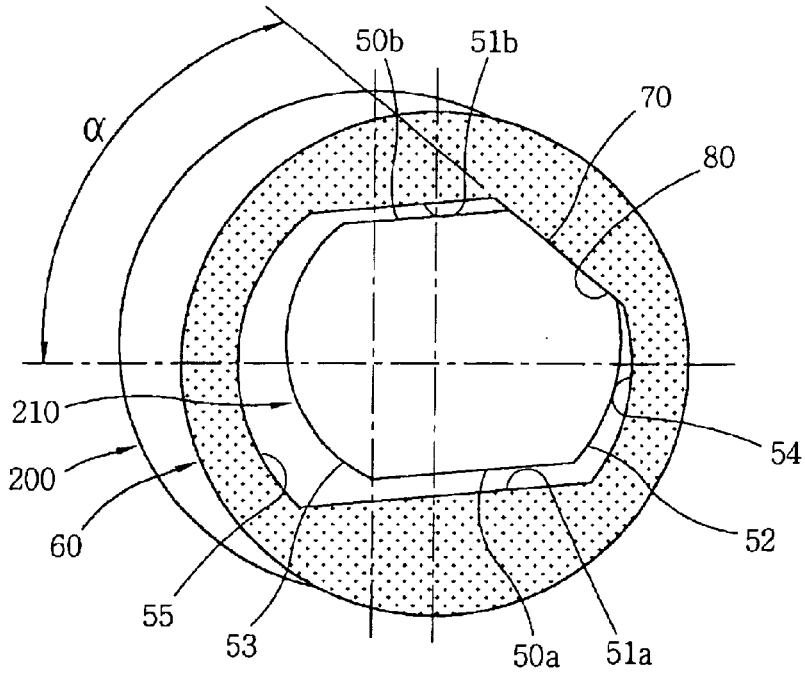
FIG. 5 is a plane view of FIG. 3 showing an eccentric portion of a rotational shaft and a slide bush in rotating in a reverse direction according to the present invention.

FIG. 3 is a disassembled perspective view showing an eccentric portion of a rotational shaft and a slide bush. FIG. 4 is a plane view of FIG. 3 showing an eccentric portion of a rotational shaft and a slide bush in rotating in a forward direction according to the present invention. FIG. 5 is a plane view of FIG. 3 showing an eccentric portion of a rotational shaft and a slide bush in rotating in a reverse direction according to the present invention.

As shown in FIG. 3, an apparatus for preventing reverse rotation of a scroll compressor according to the present invention includes a cylindrical eccentric portion 210 formed at one end of a shaft portion 200 of a rotational shaft 23 connected to a driving unit (D) and thus rotated so as to be eccentric from the axis of the shaft portion 200; and a cylindrical slide bush 60 having a inserting hole 400 penetrating its center so as to be coupled with the eccentric portion 210 at a variable gap therebetween.

At an outer circumferential surface of the eccentric portion 210, two outer planes 50*a* and 50*b* are oppositely formed to be parallel to or have a certain angle on the basis of a reference line connecting the center of the shaft portion 200 of the rotational shaft and the center of the eccentric portion 210. Between both ends of the outer planes 50*a* and 50*b*, an outer outer-circumferential surface 52 and an inner outer-circumferential surface 53 are formed respectively. And a first sloping plane 70 is extended from the outer plane 50*a*, one of the outer planes 50*a* and 50*b*, which is positioned toward a reverse rotation direction on the basis of the reference line. The first sloping plane 70 is formed to be adjacent to an outer circumference of the shaft portion of the rotational shaft.

An inner circumferential surface of the inserting hole 400 formed at the slide bush 60 is formed to confront with the planes formed at the outer circumference surface of the eccentric portion 210. Two inner planes 51*a* and 51*b* are formed at the inner circumferential surface of the inserting hole 400 respectively so as to confront in parallel with the two outer planes 50*a* and 50*b* of the eccentric portion 210. Between the inner planes 51*a* and 51*b*, an outer inner-circumferential surface 54 and an inner inner-circumferential surface 55 are formed respectively. A second sloping surface 80 is slopingly extended from the inner surface 51*b*, one of the inner planes 51*a* and 51*b*, which is positioned toward a reverse rotation direction on the basis of the reference line. The second sloping plane 80 is formed to be adjacent to an outer circumference of the shaft portion of the rotational shaft.

According to this, when the outer plane 50*a*, one of the outer planes 50*a* and 50*b* of the eccentric portion 210 of the rotational shaft, from which the first sloping plane 70 is not extended, and the inner plane 51*a*, one of the inner planes 51*a* and 51*b* of the slide bush 60, from which the second sloping surface 80 is not extended, are in contact with each other, and operated in a forward direction, that is, in a direction of compressing a fluid, these two planes become a forward rotation operating surface 50*a* and 51*a*. On the contrary, when the first sloping plane 70 of the eccentric portion 210 and the second sloping plane 80 of the slide bush are in contact with each other, and operated in a reverse direction, that is, in a direction opposite to a direction of compressing a fluid, these two planes become a reverse rotation operating surface 70 and 80.

Here, an angle between the operating surfaces 70 and 80 in the reverse rotation and the reference line is greater than an angle between the operating surfaces 50*a* and 51*a* in the forward rotation and the reference line by a predetermined value.

Meanwhile, it is advisable that the angle between the reference line and the operating surfaces 70 and 80 in the reverse rotation is between 45 and 90 degrees.

Hereinafter, operations of an apparatus for preventing reverse rotation for the scroll compressor according to the present invention will now be described.

FIG. 4 is a plane view showing a positional relation between the eccentric portion of the rotational shaft and a slide bush when the rotational shaft of the scroll compressor rotates in a direction of compressing a fluid according to the present invention. FIG. 5 is a plane view showing a positional relation between the eccentric portion of the rotational shaft and the slide bush when the rotational shaft of the scroll compressor rotates in a reverse direction.

As shown in FIGS. 4 and 5, an operation angle between the reference line, which connects the center of the shaft portion 200 of the rotational shaft 23 and the center of the eccentric portion 210, and the reverse rotation operating surface 70 and 80 is greater than that between a reference line and the forward rotation operating surface 50*a* and 51*a* by a predetermined value. Through this difference of angles, in rotating in a forward direction of compressing a fluid, a wrap of the orbiting scroll 8 is adhered to a wrap of the fixed scroll 7 by a proper force operating in a radial direction so that gas can be compressed in a compression space formed by the two wraps. Also, in rotating in a reverse direction, by the force operating in a radial direction, a frictional force between the orbiting scroll 8 and the fixed scroll 7 is greater than activating torque of a motor of the driving unit (D) so that reverse rotation of the compressor can be prevented.

In general, the force operating in a radial direction can be simply calculated by an expression below.

$$Frs=F\omega-Fgr+Fgt\cdot\tan(\alpha-\phi)$$

herein, $F\omega=F\omega.os+F\omega.sb$ (centrifugal force of orbiting scroll+centrifugal force of slide bush)

$Fgr=2\times a\times h\times(Pd-Ps)$: gas reaction force operating in a radial direction Pd: discharge pressure Ps: suction pressure a: radius of basic circle having scroll wrap form h: height of wrap Fgt: gas reaction force operating in a tangent line direction (determined by form of wrap and operation condition of compressor $\alpha$: operation angle $\phi$: $\alpha\tan(\tau)=0.05$ ($\tau$: surface friction coefficient of operation surface)

In case of a general compressor, in consideration that Fgt is 10 times more than Fgr, Frs (force operating in a radial direction) rapidly increases according to an increase of an operation angle ($\alpha$).

As so far described, the apparatus for preventing reverse rotation of a scroll compressor according to the present invention can prevent damage of the compressor, which is caused because the inside of the compression unit forms a vacuum in case that a driving unit of the compressor is driven in a direction opposite to the direction of compressing a fluid, or that the driving unit is driven in the opposite direction since a load generated during an operation of the compressor is greater than motor torque. Consequently, safety and reliability of the compressor can be improved, and productivity is also improved since the apparatus for preventing reverse rotation has a simple structure to be easy to be produced. In addition, the apparatus for preventing reverse rotation can implement the same function as in case of adding a conventional reversed-phase preventing circuit or applying a single direction clutch structure with much reduced expenses.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing a reverse rotation of a scroll compressor including a casing, a fixed-scroll installed inside the casing, a orbiting scroll meshed with the fixed scroll and defining a compression unit therewith, a rotational shaft having a shaft portion coupled with a driving unit and an eccentric portion integrally formed to be eccentric from the center of one end of the shaft portion and a slide bush having a inserting hole therein and interposed between the eccentric portion of the rotational shaft and the orbiting scroll, wherein said apparatus comprises:

the eccentric portion of the rotational shaft having two outer planes formed at an outer surface thereof, and a sloping plane extended from one of the two outer planes, the sloping plane sloping on the basis of a reference line connecting the axis of the shaft portion of the rotational shaft and that of the eccentric portion thereof; and the slide bush having two inner planes formed at an inner surface of the inserting hole thereof for confronting with the planes formed at an outer surface of the eccentric portion of the rotational shaft, and a sloping plane slopingly extended from one of the two inner planes on the basis of the reference line.

2. The apparatus of claim 1, wherein the outer plane, one of the two outer planes of the eccentric portion of the rotational shaft, from which the sloping plane is not extended, is formed toward a rotating direction of compressing a fluid on the basis of the reference line.

3. The apparatus of claim 1, wherein the outer plane, one of the two outer planes of the eccentric portion of the rotational shaft, from which the sloping plane is extended, is formed toward a direction opposite to the rotating direction of compressing a fluid on the basis of the reference line.

4. The apparatus of claim 1, wherein one of the two inner planes of the slide bush, from which the sloping surface is not extended, is formed toward a rotating direction of compressing a fluid on the basis of the reference line.

5. The apparatus of claim 1, wherein one of the two inner planes of the slide bush, from which the sloping surface is extended, is formed toward a direction opposite to the rotating direction of compressing a fluid on the basis of the reference line.

6. The apparatus of claim 1, wherein the sloping surface of the eccentric portion is formed to be adjacent to an outer circumference of the shaft portion of the rotational shaft.

7. The apparatus of claim 1, wherein the sloping surface of the slide bush is formed to be adjacent to an outer circumference of the shaft portion of the rotational shaft.

8. The apparatus of claim 1, wherein, in rotating in a forward direction of compressing a fluid, the outer plane from which the sloping plane of the eccentric portion is not extended and the inner plane from which the sloping plane of the slide bush is not extended, are in contact with each other, and thus, become a operating surfaces, through which the rotational force generated from the driving unit is transmitted to the orbiting scroll; and in rotating in a direction opposite to the direction of compressing a fluid, the sloping plane of the eccentric portion and the sloping plane of the slide bush are in contact with each other, and become a operating surfaces, through which said rotational force is transmitted to the orbiting scroll.

9. The apparatus of claim 8, wherein an angle between the operating surfaces in the reverse rotation and the reference line is greater than an angle between the operating surfaces in the forward rotation and the reference line by a predetermined value.

10. The apparatus of claim 9, wherein the angle between the reference line and the operating surfaces in the reverse rotation is between 45 and 90 degrees.

* * * * *